United States Patent [19]

Tsang

[11] 4,318,633

[45] Mar. 9, 1982

[54] CONTAMINATION CONTROL BOOM ARRANGEMENT

[76] Inventor: Gee Tsang, 3 Coventry Dr., Guelph, Ontario, Canada

[21] Appl. No.: 44,240

[22] Filed: May 31, 1979

[51] Int. Cl.[3] ..... E02B 15/04

[52] U.S. Cl. ..... 405/63; 210/923; 405/61

[58] Field of Search ..... 405/26, 27, 28, 60, 405/61, 63; 210/242 R, DIG. 25, 923

[56] References Cited

U.S. PATENT DOCUMENTS 3,779,385 12/1973 Strohecker ..... 405/63 X
4,014,795 3/1977 In't Veld ..... 405/63 X

OTHER PUBLICATIONS

"Spill Technology Newsletter," Environmental Emergency Branch, Environmental Protection Service, Ottawa, Canada, vol. 3(2), ISSN 0381-4459, Mar.-Apr. 1978, pp. 15-21.

*Canada and United States Cooperate in Development of Novel Ice-Oil Boom,* news release by Fisheries and Environment Canada, Apr. 21, 1978.

"Canadian Research," vol. 11, No. 4, ISSN 0319-1974, Jun. 1978, pp. 41 and 47.

*Primary Examiner*—David H. Corbin
*Attorney, Agent, or Firm*—Don B. Finkelstein

[57] ABSTRACT

A contamination control boom arrangement for utilization in flowing bodies of water such as rivers, having both a contaminating liquid spill therein, as well as solid objects floating thereon. The boom has one end mounted adjacent the shore of the river and is swingable on the mounting so that the boom may assume various angles with respect to the direction of flow of the river. The boom has a rigid flotation means extending outwardly from the bank into the river and a plurality of fins pivotally coupled to the downstream side of the flotation means. Fin moving means are provided to vary the angle which the fin makes with the flotation means and thereby vary the angle which the flotation means makes with the direction of flow of the river. Fluid passageways are provided through the rigid flotation means at the water line thereof. The liquid contamination can thus flow through the fluid passageways into the region immediately adjacent the downstream side of the boom and, because of the rigid nature of the boom, the downstream side is comparatively calmer than the upstream side and, further, impingement upon the fins further directs the liquid contamination toward the bank of the river, thereby allowing comparatively simple contamination removal techniques to be utilized. Large floating solid objects such as, for example, ice, cannot pass through the perforations and are deflected by the flotation means to flow around the remote end thereof and thus stay clear of the area into which the liquid contamination is directed.

10 Claims, 5 Drawing Figures

CONTAMINATION CONTROL BOOM ARRANGEMENT

BACKGROUND OF THE INVENTION

1. Field of the Invention

This invention relates to the contamination control art, and, more particularly, to a contamination control boom particularly adapted for flowing bodies of water which contain solid floating objects in addition to liquid contamination such as oil.

2. Description of the Prior Art

The containment and/or cleaning up of contamination on bodies of water, such as, for example, oil spills, has received considerable attention in recent years due to some rather extensive oil spills. It will be appreciated, of course, that oil spills represent only one of many types of liquid contaminants which may be present floating on a body of water. In the oil spills, or other liquid contamination, encountered on the open seas or in harbors, there has generally not been a comparatively swift flowing body of water in which it was either desired to contain the contamination to a particular area or to remove the contamination after such containment. Thus, many types of contamination control booms have heretofore been utilized in such applications, These, of course, include those booms in which a flotation member is provided and to which there is a dependent skirt attached, extending downwardly into the water. Generally, both ends of such a boom are fixed or anchored. The fixing or anchoring of the ends of the boom may be to boats or to land masses for containment of an oil spill. In many of these booms, the flotation member has been fabricated of canvas, plastic, or the like and while adequate for the above described applications, have not alway proven to be satisfactory where comparatively swift flowing bodies of water are encountered, such as in rivers, and, additionally, where such rivers may contain floating solid masses such as, for example, ice. In such applications, it is desired that the liquid contamination be diverted to regions adjacent the bank or shore of the river, where the velocity is lower and, further, that the large floating masses, such as ice, be deflected away from the area where the liquid contamination is directed.

In the pulp and paper industry, glance booms, have been utilized, in which a segmented boom, having pivotally mounted fins on the downstream side thereof, had one end mounted on the bank or shore and the boom extended outwardly into the river. The fins were movable to change the angle that the boom made with the direction of flow. The pulp floating on the body of water would impinge upon the boom and be guided around the boom to the remote end thereof, where it was suitable collected. The segmented boom, when contacted by comparatively large mass solid objects such as ice, tended to have an excess deformation, and, further, no channels were provided to allow the flow of liquid through the boom.

In other applications, deflection booms, which were in the form of individual fins clipped on to conventional booms, have been proposed. This configuration converted the boom to a straight deflection boom which was moored at its upstream end. Upon encountering the boom, the floating liquid contaminant was guided around the end of the boom for recovery. However, such booms did not provide for a separation of the liquid contaminant floating on the body from the comparatively large solid masses such as ice which may also accompany such liquid contamination. Deflectors have been proposed to deflect the contaminant together with the surface layer, however, comparatively massive deflectors and mooring structures were often needed in such applications in order to deflect a sufficient depth of the surface layer which, in some applications, was several meters deep.

Consequently, there has long been a need for a contamination control boom, particularly adapted for utilization in comparatively rapidly flowing bodies of water such as rivers, in which the liquid contamination is also accompanied by large masses of floating solids such as ice, and in which the floating liquid contamination can be directed to a convenient location for removal and the floating solids such as ice are deflected to a different location so as not to interfere with the removal of the liquid contaminant.

SUMMARY OF THE INVENTION

Accordingly, it is an object of the present invention to provide an improved contamination control boom arrangement.

It is another object of the present invention to provide an improved contamination control boom particularly adapted for utilization in comparatively rapidly flowing bodies of water such as rivers or the like.

It is yet another object of the present invention to provide improved contamination control boom arrangement in which the floating liquid contamination may be conveniently separated from accompanying large floating solid objects such as ice.

It is another object of the present invention to provide an improved contamination control boom arrangement in which the floating liquid contamination is directed into a first path and large floating solid objects such as ice are deflected into a second path different from the first path.

The above and other objects of the present invention are achieved, according to a preferred embodiment, by providing a contamination control boom arrangement having a rigid flotation means and an elongated longitudinal axis between a first end and a second end thereof. The rigid flotation means has a top surface, a bottom surface, a water line intermediate the top surface and the bottom surface, and a freeboard portion extending above the water line and a keel portion extending below the water line. The first end of the flotation means is coupled to the bank or shore of the river by a cable which allows the flotation means to swing in the river to vary the angle which the rigid flotation means makes with the direction of flow of the river. The flotation means also has first walls defining a fluid passageway extending therethrough from the upstream surface to the downstream surface. The passageway may be a single passageway or a plurality of passageways in a spaced relationship along the longitudinal length of the flotation means. The passageways make a particular angle with respect to the longitudinal axis of the flotation means, and, in preferred embodiments of the present invention, such an angle is on the order of 45°.

Fin means, which may be one or more fin members, are mounted on the downstream side of the flotation means, and, preferably, are pivotally mounted thereon, so that they may be moved to vary the angle of the fin means with respect to the longitudinal axis of the flotation means. Varying the angle that the fin means makes with the longitudinal axis of the flotation means causes the flotation means to vary the angle which it makes with the direction of flow of the body of water. A cable may be coupled to the outer ends of the fin means and the cable may lead to a winch or similar structure mounted on the bank or shore of the river adjacent to where the rigid flotation means is anchored by its cable and the winch may be utilized to vary the angle of the fin members with respect to the longitudinal axis of the flotation means.

In deployment of the boom according to the present invention the fins are initially positioned substantially parallel to the flotation means, thus making an angle of 180° with respect to the longitudinal axis of the flotation means and extending toward the downstream or second end of the flotation means. As the flotation means floats out upon the body of water, it initally assumes an alignment with the direction of flow of the body of water. The fins are then moved by the cable to reduce the angle from 180° and changing the angle causes the boom to swing outwardly into the river. It is desired, of course, to have the flotation means make the maximum angle possible with respect to the direction of flow of the river, so that a minimum length of boom arrangement is required to extend a given distance outwardly from the bank into the river.

When the boom has been positioned at its desired location, and at its desired angle with respect to the direction of flow of the river, liquid contamination floating on the river flows through the fluid passageways, impinges upon the fins, and is deflected toward the adjacent shore. The comparatively large floating solid objects such as ice, which have a dimension too great to pass through the fluid passageways, are deflected by the boom outwardly around the remote end thereof. The region on the downstream side of the boom is comparatively low velocity, thus allowing removal of the contamination with a minimum of complexity. Further, separation of the large floating solid objects such as ice from this area where the liquid contamination is gathered, further enhances the ability to rapidly remove the contamination by conventional means from the body of water.

In another embodiment of the present invention, two such contamination control boom arrangements may be utilized, one coupled to each bank or shore of the river, and, for example, one boom upstream from the other. Preferably, in such an embodiment, the length of the boom is sufficient so that at the desired angle with respect to the direction of flow, there is at least some overlap between the booms. In such an arrangement, of course, a large solid floating object such as ice, is deflected by both booms and passes therebetween around the remote ends thereof, while the floating liquid contamination is diverted by each boom into regions adjacent the respective shores to which the booms are anchored or coupled.

BRIEF DESCRIPTION OF THE DRAWING

The above and other objects of the present invention may be more fully understood from the following detailed description, taken together with the accompanying drawing, on which similar reference characters refer to similar elements throughout, and in which.

DESCRIPTION OF THE PREFERRED EMBODIMENT

Figure 1:
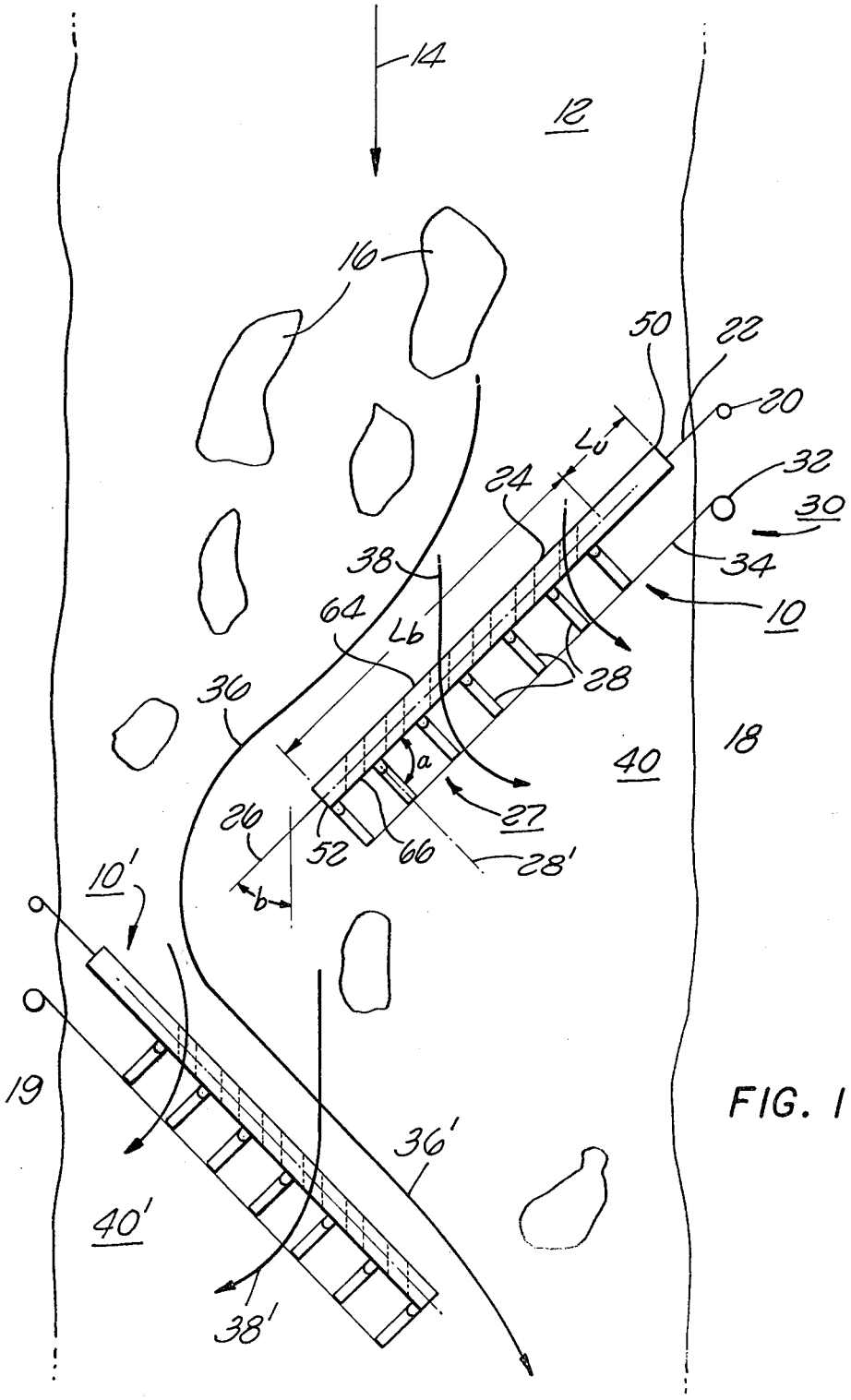
FIG. 1 is a diagrammatic representation of a contamination control arrangement in a river, according to the principles of the present invention.

Referring now to the drawing, there is illustrated in FIG. 1, a contamination control boom arrangement, generally designated 10, according to the principles of the present invention. As shown in FIG. 1, the contamination control boom 10 is positioned in a river 12, in which the direction of flow is indicated by the arrow 14. The river 12 may have large solid objects, such as ice floes 16, floating therein as well as contamination floating on the surface of the river 12. It will be appreciated, of course, that the present invention is not limited to applications involving a river, and/or in which the large solid floating objects are ice floes. Rather, the present invention may be utilized in any flowing body of water where there may be, in addition to a contaminant floating on the water, also other large solid objects, such as debris, logs, or the like.

The contamination control boom 10 is adjacent a first bank or shore 18 of the river 12 and is anchored thereto at 20 by a flotation mounting means 22, such as a cable, coupled to the anchoring point 20 and to a rigid flotation means 24. The flotation mounting means 22 allows the rigid flotation means 24 to swing in the river 12 relative to the direction of flow 14 thereof. The rigid flotation means 24 has a longitudinal axis 26 which, as illustrated on FIG. 1 makes an angle "b" with the direction of flow 14 of the river 12.

Fin means 27, comprising a plurality of fin members 28 are mounted on the flotation means 24, and, preferably, are pivotally mounted thereon for pivotal movement thereon, so that the angle "a" made by the fin axis 28' with respect to the longitudinal axis 26 of the rigid flotation means 24, may be selectively varied. To achieve this variation in the angle "a" of the fin members 28, with respect to the longitudinal axis 26 of the flotation means 24, a fin moving means generally designated 30, is provided and generally comprises a winch 32 on the bank or shore 18 to which there is connected a cable means which connects to the outer ends of fin members 28. Thus, each of the fin members 28 move in unison and each will make the same angle "a" with respect to the longitudinal axis 26 of the rigid flotation means 24.

According to the principles of the present invention, it is desirable to deflect the large floating solid object 16 into a first path generally designated 36 around the flotation means 24, but to allow the contamination, such as an oil spill, to flow through the rigid flotation means 24 as indicated by the arrow 38 in a second path different from the path 36 and into an area generally designated 40, adjacent to the shore 18. The area 40 is a comparatively protected area in which the velocity of flow of the river 12 is much lower than in regions adjacent the center of the river 12 and, further, adjacent to the bank or shore 18. Contamination removal structures may be conveniently located to remove the liquid contaminants such as an oil spill from the river 12 in the region 40.

If desired, a second contamination control boom 10', substantially identical to the contamination control boom 10, described above, may be mounted adjacent the second or opposite shore or bank 19 of the river 12, downstream from the contamination control boom 10, and it serves the same function and purpose by deflecting the large floating solid objects such as ice floes 16 in a path 36' around the boom 10' and deflecting the liquid contaminant such as an oil spill in a second path 38', different from the path 36' to the region 40' adjacent the second shore or bank 19, where it may be conveniently removed by conventional contamination removal equipment. Thus, the regions 40 and 40' are substantially free of the large ice floes 16, thus facilitating the removal of the spilled contaminant.

The flotation means 24 has its first end 50 coupled to the flotation mounting means cable 22, adjacent to the shore or bank 18, and its second end 52 spaced outwardly therefrom to provide an elongated longitudinal length. The total length of the flotation means 24 is comprised of the length $L_b$ and the length $L_u$. It is preferred to have the area $L_u$ extending from the first end 50 a predetermined distance and the length $L_u$ substantially free of fin members 28. It has been found that providing this area $L_u$ adjacent to the shore 20 free of the fin members 28 prevents the large ice flows 16 from floating around the inner end 50 and impinging upon the fin members 28, which could tend to damage or destroy them.

Figure 2:
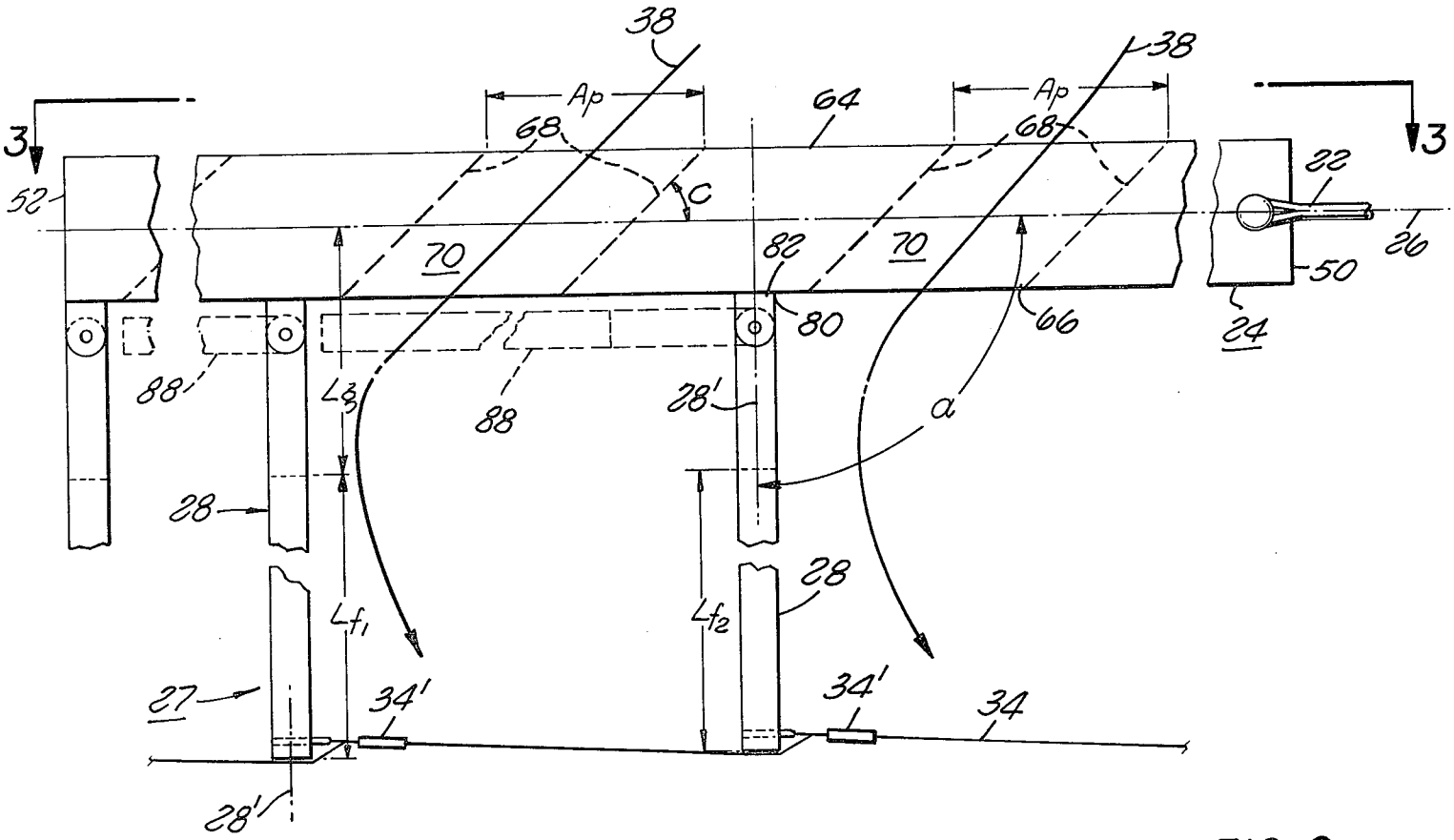
FIG. 2 is a plan view of a contamination control boom section, useful in the practice of the present invention.
Figure 3:
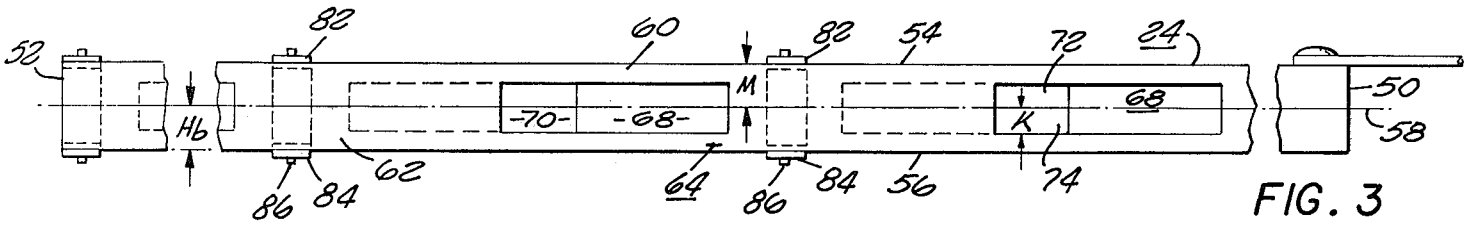
FIG. 3 is a view along the line 3—3 of FIG. 2.

Referring now to FIGS. 2 and 3, there is illustrated a preferred embodiment of a contamination control boom arrangement 10. As shown thereon, the flotation means has a top surface 54, a bottom surface 56, and, when in the river 12, has a water line 58, intermediate the top surface 54 and bottom surface 56.

The rigid flotation means 24 has a freeboard portion 60 extending above the water line 58 a distance indicated by the letter "M." The rigid flotation means 24 also has a keel portion 62 extending below the water line 58 and, when the boom 10 is in the river 12, extends below the surface of the water and the depth of the keel portion 62 in the water from the center line 58 to the bottom surface 56 is indicated as $H_b$. The flotation means 24 also has an upstream facing surface 64 and a downstream surface 66 facing away from the direction of flow 14 of the river 12 when installed therein.

The rigid flotation means 24 is also provided with first walls 68 defining a fluid passageway means 70, extending through the rigid flotation means 24 from the upstream surface 64 to the downstream surface 66 thereof. The fluid passageway 70 has a portion 72 extending above the water line 58 and a portion 74 extending below the water line as indicated by the letter "K," which is less than the distance $H_b$. In preferred embodiments of the present invention, the fluid passageway means 70 has an angle indicated by the letter "c," with the longitudinal axis 26 of the rigid flotation means 24. It has been found that the angle "c" is preferably in the range of 20° to 50° and, preferably, approximately 45°. Further, while the depth "k" of the fluid passageway means 70 is less than the keep height $H_b$ of the flotation means 24, in some applications, it may be desirable to have the depth "K" equal to the height $H_b$ and thus the passageway 70 extends all the way to and through the lower surface 56 of the rigid flotation means 24. The fluid passageway means 70 has an area $A_p$ and the total of the areas $A_p$ of all of the fluid passageway means 70 has a value in the range of 25% to 60% of the area of the upstream surface 64 of the rigid flotation means 24.

Figure 4:
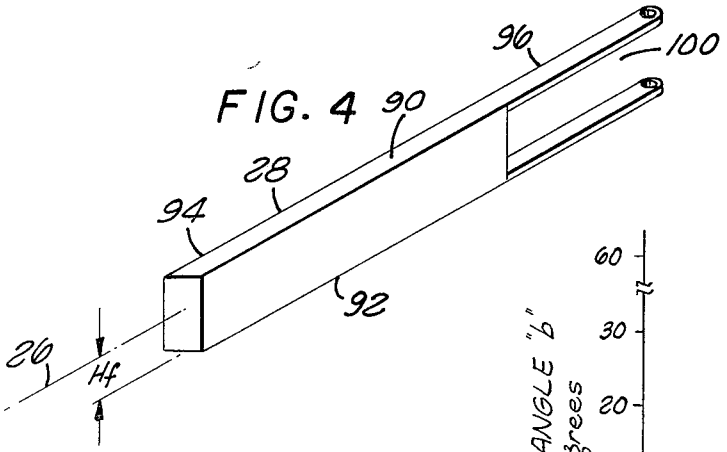
FIG. 4 is a perspective view of the fin useful in the present invention.

The fin means 27 is generally comprised of a plurality of substantially identical fin members 28 mounted on the downstream surface 66 of the rigid flotation means 24. Preferably, the fin members 28 are pivotally mounted by fin mounting means 80, comprised of an upper tab 82, a lower tab 84, and a pivot pin 86. Thus, the fin members 28 can move from a fully opened position, indicated in dotted lines at 88 in which the angle "a" that the fin axis 28' makes with the longitudinal axis 26 of the rigid flotation means 24 is 180°, to a progressively closed position in which the angle "a" decreases. Thus, in the opened position indicated at 88, the fins are aligned with the rigid flotation means 24 and directed toward the second end 52 thereof. As shown more clearly on FIG. 4, each of the fin means 28 has an upper surface 90, a lower surface 92, an outer end portion, generally designated as 94, and an inner end portion 96. The outer end portion 94 is substantially solid between the upper surface 90 and lower surface 92. The lower surface 92 is spaced a distance $H_f$ from the water line 26. In preferred embodiments of the present invention, it has been found that $H_f$ is preferably equal to $H_b$, although, it will be appreciated, variations in the height $H_f$ may be made to achieve any desired fin area.

The cable 34 of the fin moving means 30 is attached to the outer end portion 94 and may, as shown in FIG. 2, be connected to each of the fin members 28 by a turnbuckle 34'. It has been found desirable to have the inner end portion 96 of the fin member 28 open to define a channel 100 therethrough. The provision of the channel 100 at the inner end 96 of the fin 92 has been found to decrease the turbulence in the region 40 (FIG. 1), thereby facilitating the removal of the liquid contaminant. The length of the inner end portion 96 has been found to be preferably in the range of 10% to 30% of the total length of the fin, and, preferably, is on the order of 25% thereof.

The fin members 28 and the rigid flotation means 24 may, of course, be fabricated from wood or other suitable materials to provide the necessary flotation and structural integrity required for the particular applications involved. It has been found that the total height of the flotation means between the upper surface 54 and lower surface 56 thereof is preferably on the order of one foot and the fin member 28 is also on the order of one foot between the upper surface 90 and lower surface 92 thereof.

Figure 5:
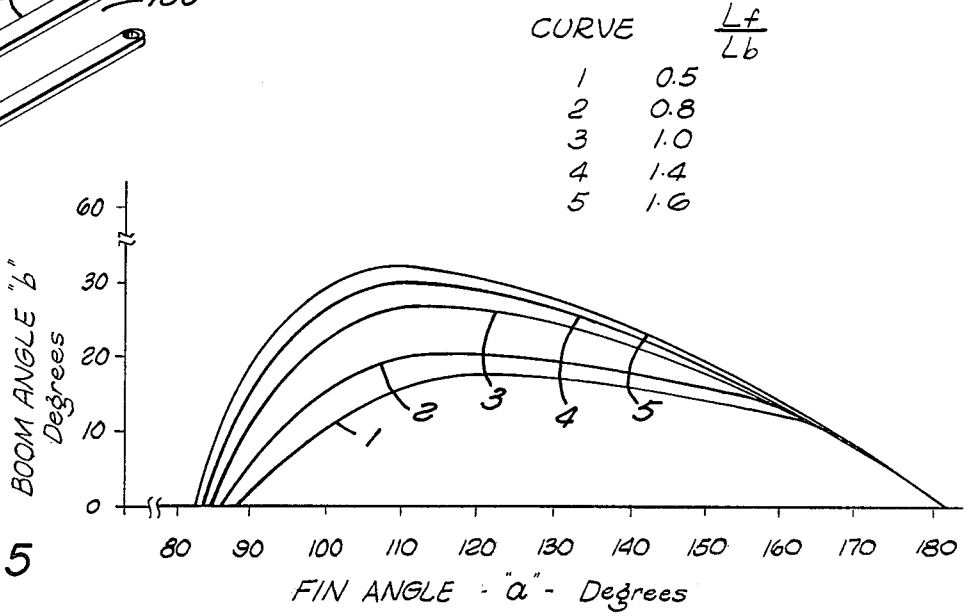
FIG. 5 is a graphical representation of certain operating characteristics of the boom according to the principles of the present invention.

FIG. 5 illustrates the variation between the fin angle "a" and the boom angle "b" for various ratios of the length of the outer end portion $L_f$ (as shown on FIG. 2 by $L_{f1}$ and $L_{f2}$ to the boom unit length $L_b/n$, n being the number of fins of the boom). As can be seen, when the sum of the lengths of the outer end portion 28 is varied between 50% of the length of the boom unit and 160% of the length of the boom unit, a maximum boom angle obtainable increases. It is, of course, preferable to have the maximum boom angle "b," since, for a given length of boom, a greater portion of the river 12 is intercepted thereby.

In an experimental test of a prototype contamination control boom fabricated in accordance with the above description and the principles of the invention herein, a boom was constructed having a total length of 120 feet, and made of wood. The boom was fabricated in six twenty foot long sections, rigidly coupled together. The flotation means 24 was fourteen inches high between the upper surface 54 and lower surface 56 thereof, and two feet wide between the upstream surface 64 and downstream surface 66 thereof. The total area of the fluid passageway means 70 was approximately 50% above the area of the upstream surface 54. The fluid passageways were at an angle "c" of approximately 45° to the longitudinal axis 26. A total of twelve fins, or two fins to each of the above mentioned sections, were provided, having an overall height between the upper surface 90 and lower surface 92 thereof of one foot. The length of the outer end portion 94 was six feet and the length of the inner end portion 96 was two feet. The velocity of the river 12 in the direction of the arrow 14 was approximately two feet per second. The fins were initially in the fully opened position indicated at 88, and gradually closed. A maximum angle "b" of the boom with respect to the direction of flow 14 was about 40° when the angle "a" was approximately 115°. Ice floes were present in the river and when such ice floes as indicated at 16 were as large as 50 feet by 50 feet, and approximately one foot thick, they were deflected smoothly in the path 36 around the second end 52 of the boom. The boom angle "b" when the boom was impinged by such floes changed only by 3° to 4°. After the ice floes had passed, the boom returned to the original angle of approximately 40°. Plastic chips were released upstream from the boom 10 to simulate an oil spill mixed with the ice floes 16. It is estimated that approximately 95% of such plastic chips were directed in the path 38 to the region 40. It has been found that after flowing through the fluid passageway means 70, the surface current of the river 12 was deflected by the fin members 28 toward the bank or shore 18 of the river 12 and, in fact, the plastic chips which simulated the oil spill actually piled up against the shore or bank 18. Thus, the use of the boom 10, in accordance with the principles of the present invention, directed the contamination spill to regions 40 adjacent to the shore or bank 18 and conventional removal apparatus on the shore or bank 18 could then be utilized to facilitate the removal of the contamination.

During the above mentioned testing, it was found that when an ice field covering almost the entire surface of the river 12 arrived at the contamination control boom 10, the contamination control boom 10 swung about the anchor point 20 to a direction substantially parallel to the direction of flow 14 and, after the ice field passed, the boom swung back to the above mentioned angle. The swinging movement of the boom when such large solid objects were encountered, prevented excessive stress being imposed upon the structure and allowed the boom to continue operation after encountering such an ice field.

From the above, it can be seen that there has been provided an improved contamination control boom arrangement particularly adapted for utilization where solid floating objects are present on the moving body of water in which there is also a contamination spill of a liquid. Those skilled in the art may find many variations and adaptations of the invention described herein, and the appended claims are intended to cover all such variations and adaptations falling within the true scope and spirit of the invention.

What is claimed is:

1. A contamination control boom arrangement of the type adapted to be placed in a body of water moving in a predetermined direction for deflecting solid objects floating in the body of water into a first path and to deflect floating liquid contaminants in the body of water into a second path different from said first path and comprising, in combination:

a rigid flotation means having an elongated longitudinal axis between a first end and a second end thereof, a top surface, a bottom surface, a water line intermediate said top surface and said bottom surface, a freeboard portion extending a first predetermined distance above said water line to said top surface, a keel portion extending a second predetermined distance below said water line to said bottom surface, an upstream surface facing into said predetermined direction of movement of said body of water and a downstream surface facing away from said predetermined direction of movement of said body of water;

said flotation means having first walls defining fluid passageway means extending therethrough from said upstream surface to said downstream surface, and said fluid passageway means extending a third preselected distance less than said first preselected distance above said water line and a fourth preselected distance less than said second preselected distance below said water line, and said fluid passageway means at a predetermined angle to said longitudinal axis of said flotation means, and said fluid passageway means having a predetermined cross-sectional area;

fin means having a fin axis on said flotation means and extending from said downstream surface thereof, and said fin means having an upper surface, a lower surface, an outer end portion spaced from said flotation means and extending a fifth preselected distance below said water line, and an inner end portion;

fin mounting means for mounting said inner end portion of said fin means to said flotation means;

flotation mounting means for mounting said first end of said flotation means at a predetermined location relative to said body of water, whereby comparatively large, solid floating objects in said body of water are deflected by said flotation means into said first path around said second end of said flotation means and liquid contaminants floating in said body of water flow through said fluid passageway means in said second path into regions adjacent said downstream surface of said flotation means.

2. The arrangement defined in claim 1, wherein:

said fin mounting means further comprises a pivotal mounting means;

said flotation mounting means further comprises a swinging mounting means;

and further comprising:

fin moving means for moving said fin means to selectively vary the angle between said fin axis and said longitudinal axis of said flotation means to vary the angle of said longitudinal axis of said flotation means with said predetermined direction of said movement of said body of water.

3. The arrangement defined in claim 2, wherein:

said fin moving means further comprises a cable means coupled to said outer end portions thereof.

4. The arrangement defined in claim 3, wherein:

said predetermined area of said fluid passageway means is in the range of 25% to 60% of the area of said upstream surface; and said predetermined angle of said fluid passageway means to said longitudinal axis of said flotation means is in the range of 20% to 50%.

5. The arrangement defined in claim 3, wherein:

said outer portion of said fin means is solid between said upper surface and said lower surface.

6. The arrangement defined in claim 5, wherein:

said inner portion of said fin means is open to define a fluid channel therethrough.

7. The arrangement defined in claim 6, wherein:

said fin means comprises a plurality of substantially identical fin members on said flotation means in a preselected spaced array and said plurality of fin members movable in unison.

8. The arrangement defined in claim 7, wherein:

a first portion of said flotation means adjacent said first end thereof is free of fins.

9. The arrangement defined in claim 8, wherein:

said inner end portion of each of said fin members is in the range of 10% to 30% of the length of said fin; and said fifth preselected distance is substantially equal to said second preselected distance; and the sum of the lengths of said outer end portions of said plurality of fins is in the range of 50% to 160% of the longitudinal length of said flotation means.

10. The arrangement defined in claim 9, wherein:

said body of water is a river and said first end of said flotation means is adjacent a bank thereof;

said flotation mounting means comprises a cable having a first end coupled to said bank and a second end coupled to said first end of said flotation means;

said flotation means is fabricated of wood;

said fin moving means further comprises a winch means mounted on said bank of said river and said cable means is connected to said winch means;

said flotation means is approximately 14 inches between said upper surface and said lower surface thereof;

the length of each of said plurality of fin members is approximately eight feet;

said predetermined area of said fluid passageway means is in the range of 25% to 60% of the area of said upstream surface; and said predetermined angle of said fluid passageway to said longitudinal axis of said flotation means is in the range of 20% to 50%;

the axis of each of said plurality of fin members is movable to provide an angle in the range of 90% to 130% with said longitudinal axis of said flotation means;

said longitudinal axis of said flotation means is at an angle in the range of 10% to 35% to said predetermined direction of flow of said river.

* * * * *